US012716672B2

(12) United States Patent
Barnhart

(10) Patent No.: US 12,716,672 B2
(45) Date of Patent: Aug. 25, 2026

(54) MACHINE GUN TRIGGER ASSEMBLY

(71) Applicant: Sig Sauer, Inc., Newington, NH (US)

(72) Inventor: Brian J. Barnhart, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 136 days.

(21) Appl. No.: 18/915,666

(22) Filed: Oct. 15, 2024

(65) Prior Publication Data

US 2025/0123068 A1 Apr. 17, 2025

Related U.S. Application Data

(60) Provisional application No. 63/590,826, filed on Oct. 17, 2023.

(51) Int. Cl.
*F41A 19/10* (2006.01)

(52) U.S. Cl.
CPC ..... *F41A 19/10* (2013.01)

(58) Field of Classification Search
CPC ..... F41A 19/10
See application file for complete search history.

(56) References Cited

U.S. PATENT DOCUMENTS

2019/0195588 A1* 6/2019 Lake ..... F41A 19/10
2020/0182574 A1* 6/2020 Fellows ..... F41A 19/06
2025/0230997 A1* 7/2025 Kras ..... F41A 3/66

OTHER PUBLICATIONS

Altin Gaming "This is how M2 Browning Works" Youtube (May 16, 2019); https://www.youtube.com/watch?v=GFri-znNRYI.
Spade Grip for FN M240 Machine Gun (admitted prior art).

* cited by examiner

*Primary Examiner* — J. Woodrow Eldred
(74) *Attorney, Agent, or Firm* — Secant IP, PLLC

(57) ABSTRACT

A trigger lever assembly includes a link rotatable between a first position and a second position. The link has a first leg extending from an axis of rotation to a first end portion and a second leg extending from the axis of rotation to a second end portion. A trigger lever is mounted to the first end portion of the link and is rotatable between a blocked position and an unblocked position. The trigger lever is biased toward the blocked position. In the blocked position, a second end portion of the trigger lever contacts a first protrusion on the link. On the other hand, when the trigger lever is in the unblocked position, the second end portion of the trigger lever abuts a second protrusion on the link. The assembly can be part of a spade grip assembly or part of a complete machine gun.

20 Claims, 11 Drawing Sheets

MACHINE GUN TRIGGER ASSEMBLY

RELATED APPLICATIONS

This application claims the benefit under 35 U.S.C. § 119 (e) of U.S. Provisional Patent Application No. 63/590,826 titled MACHINE GUN TRIGGER ASSEMBLY and filed on Oct. 17, 2023, the contents of which are incorporated herein by reference in its entirety.

TECHNICAL FIELD

The present disclosure relates generally to firearms and more particularly, the present disclosure relates to a trigger assembly for a machine gun.

BACKGROUND

A machine gun is typically characterized by being configured for sustained fully automatic fire using belt-fed ammunition. The machine gun is mainly used as an infantry support weapon and is often fired from a bipod or from a fixed mount on a vehicle, for example. Examples of machine guns include the Barrett M240 and the Browning M2 machine gun. To mitigate overheating, the machine gun most typically has an open-bolt operation and quick-change barrels. In general, machine guns can be fired using a trigger that is located below the gun's receiver, where the operator's finger directly engages and pulls the trigger. For machine guns that are mounted to a vehicle, the gun alternately can be aimed and fired using a spade grip that is mounted to the rear end of the gun.

SUMMARY

The present disclosure is directed to a trigger lever assembly for a machine gun. In accordance with one example embodiment, the trigger lever assembly includes a trigger lever that pulls the gun's trigger when the lever is pressed. The trigger lever assembly can be part of a spade grip assembly or part of a complete firearm. In use, the operator can push down on the trigger lever to pull the gun's trigger. In the event of an impulse, such as due to dropping the firearm or jostling of the vehicle to which it is mounted, the components of the trigger assembly are configured to resist or prevent inadvertently firing the gun.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
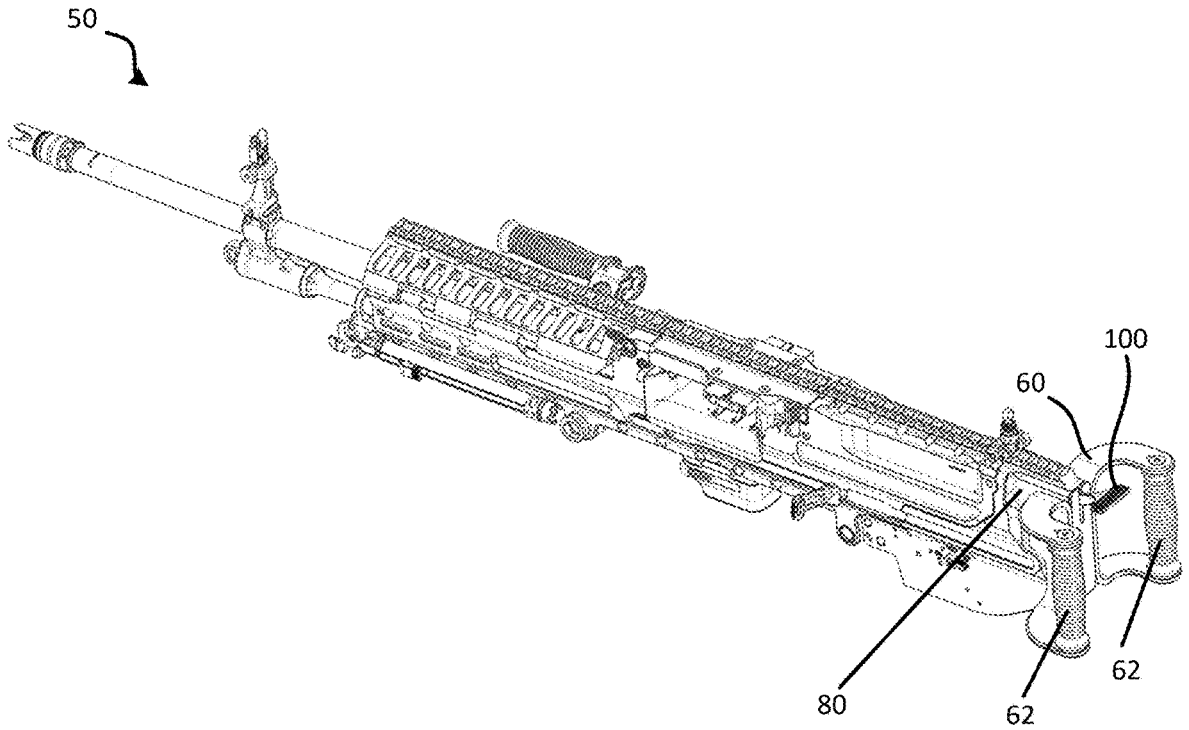
FIG. 1 is a top, front, and side perspective view showing a machine gun with a spade grip and trigger lever assembly, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a trigger lever assembly for a machine gun. In one example embodiment, the assembly includes a trigger lever that is pivotably mounted to a housing. When the operator presses down on the first end of the trigger lever, the lever moves into contact with a first link, which in turn rotates and moves second and third links. The third link is arranged to pull the gun's trigger to the firing position after a moving through a take-up portion of the link's stroke. The lever assembly includes a block surface, such as a pin or protrusion on the housing, that reduces or prevents the occurrence of inadvertent discharge due to an impulse.

In one embodiment, when the user pushes down on a first end the trigger lever, an opposite end of the trigger lever moves into a clearance position with respect to the blocking surface prior to the second end of the trigger lever engaging and rotating the first link. Further pressing down on the first end of the trigger lever rotates the first link, which in turn moves the second link and draws the third link rearward toward the firing position. The centers of gravity for the trigger lever and the combination of the trigger lever and the first link are arranged so that in the event of an impulse, the second end of the trigger lever will contact the block surface, preventing the first link from rotating to a firing position. Accordingly, the second and third links do not move to the firing position and an unintentional discharge is avoided.

Overview

Machine guns are commonly mounted to the body of a helicopter, Humvee, or other vehicle. Land vehicles often pass over rough and uneven terrain, resulting in the vehicle hitting the ground after a bump or after going over a ledge, for example. Similarly, helicopters and other aircraft may experience turbulence and direction changes that impart similar forces on the machine gun. This type of jostling can impart acceleration on components of a fire control assembly that may result in the trigger being pulled or the sear otherwise releasing the bolt and firing the gun. An unintended discharge can result in death or serious injury.

Therefore, a need exists for an improved trigger lever assembly for a machine gun. The present disclosure addresses this need and others by providing a trigger lever assembly, a spade grip assembly that includes the trigger lever assembly, and a machine gun with the trigger lever assembly.

As discussed herein, terms referencing direction, such as upward, downward, vertical, horizontal, left, right, front, back, etc., are used for convenience to describe embodiments of a trigger lever assembly configured for use with a machine gun oriented in a traditional shooting position in which the barrel extends horizontally in front of the user. Embodiments of the present disclosure are not limited by these directional references, and it is contemplated that a trigger lever assembly, firearm, and related components of the present disclosure could be used in any orientation.

Also, it should be noted that, while generally referred to herein as a trigger lever for consistency and ease of understanding the present disclosure, the disclosed trigger lever is not limited to that specific terminology and alternatively can be referred to, for example, as a remote trigger, a butterfly trigger, a spade grip trigger, or other terms. Numerous variations and embodiments will be apparent in light of the present disclosure.

Example Embodiments

Figure 2:
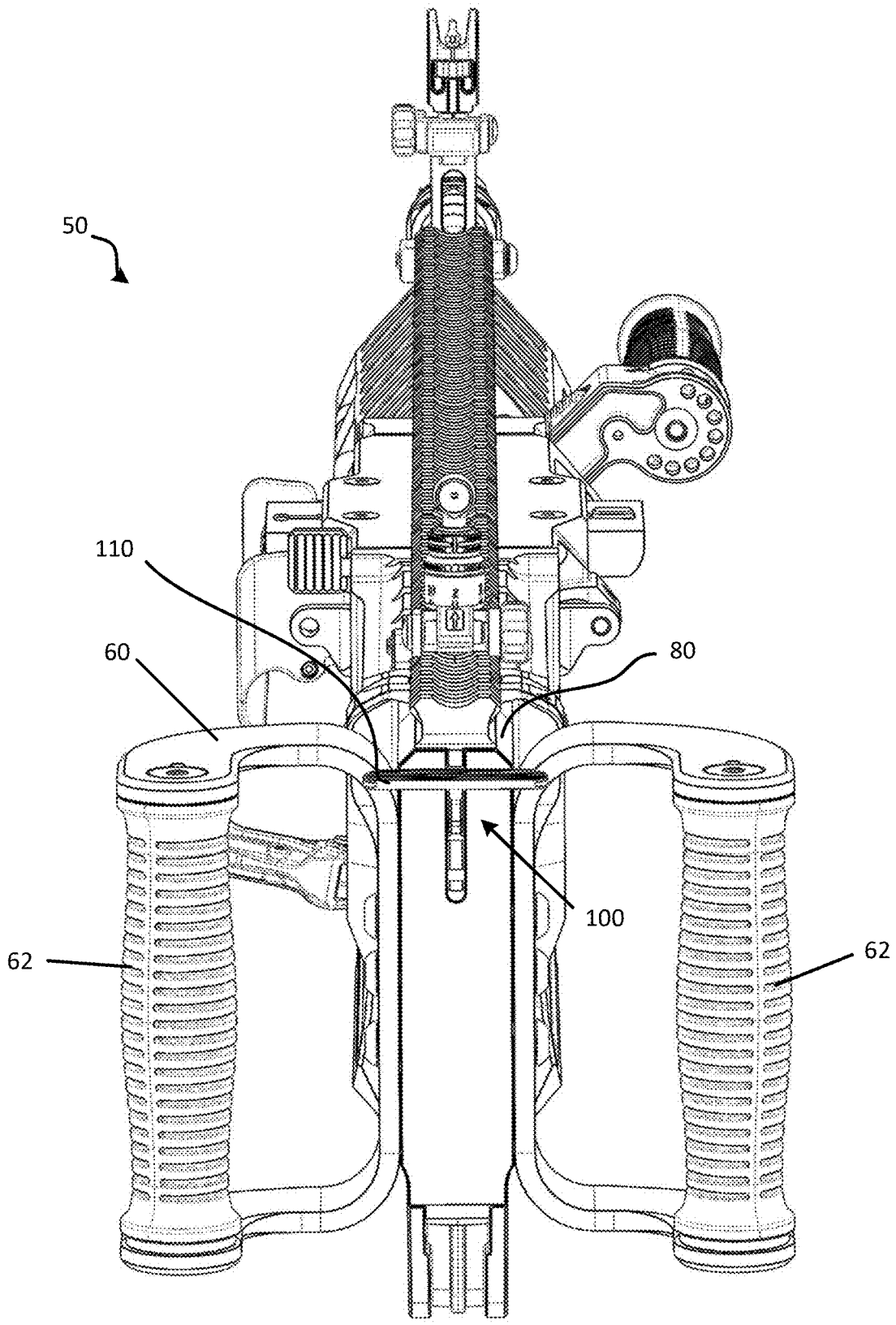
FIG. 2 is a rear perspective view of a machine gun equipped with a spade grip and trigger lever assembly, in accordance with an embodiment of the present disclosure.

FIG. 1 is a top, front, and side perspective view showing a machine gun 50 with a spade grip 60 and trigger lever assembly 100, in accordance with an embodiment of the present disclosure. FIG. 2 shows a rear perspective view of the machine gun 50 of FIG. 1. The spade grip 60 includes two handles 62 that are mounted to opposite sides of a housing 80. The trigger lever assembly 100 includes a trigger lever 110, part of which is positioned between the handles 62 for manipulation by the operator and part of which is received in the housing 80. The housing 80 is attached to the machine gun 50. In some embodiments, the trigger lever assembly 100 includes the housing and/or the spade grip 60.

Figure 3A:
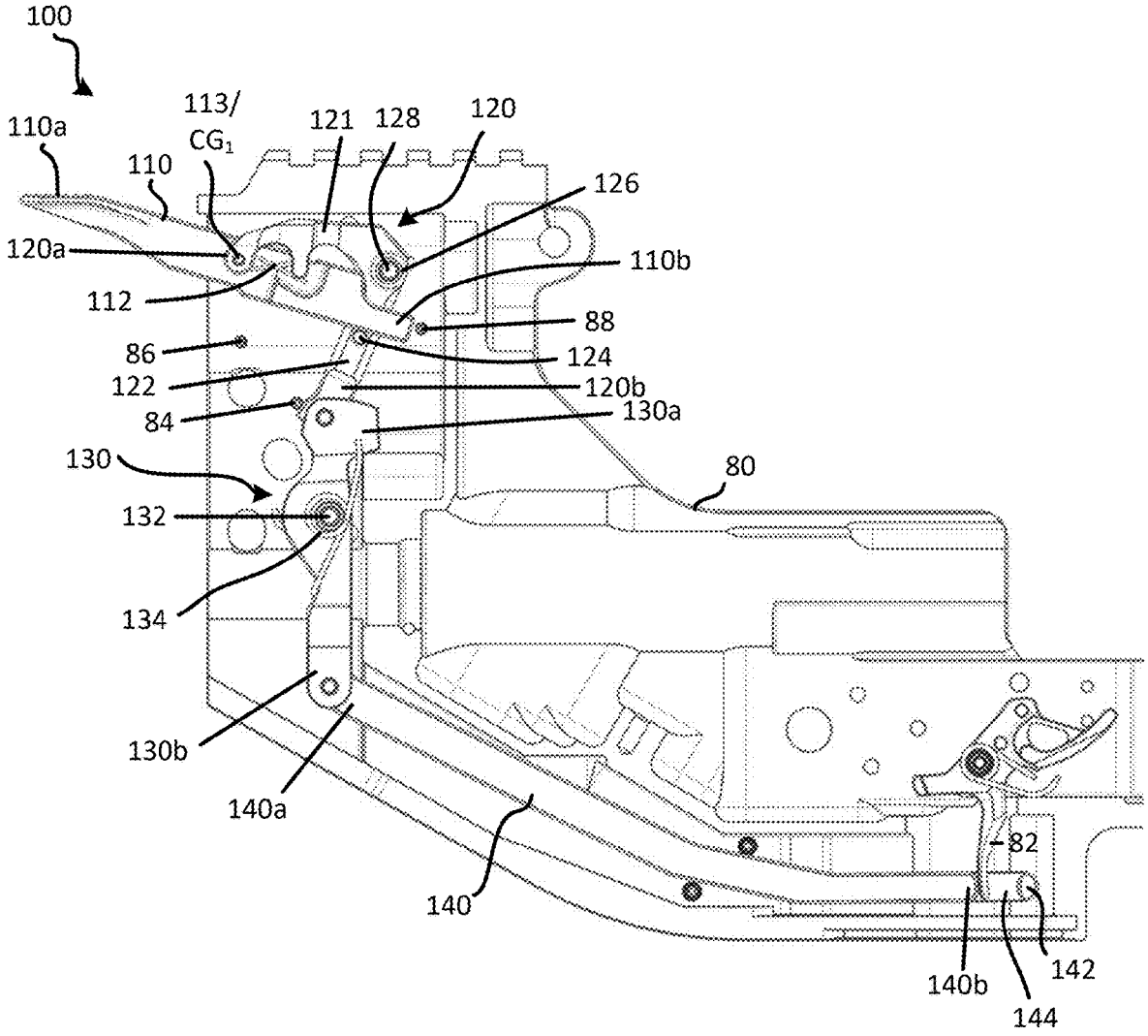
FIG. 3A illustrates a side view of a housing and components of a trigger lever assembly, where the housing is illustrated as being transparent, in accordance with an embodiment of the present disclosure.
Figure 3B:
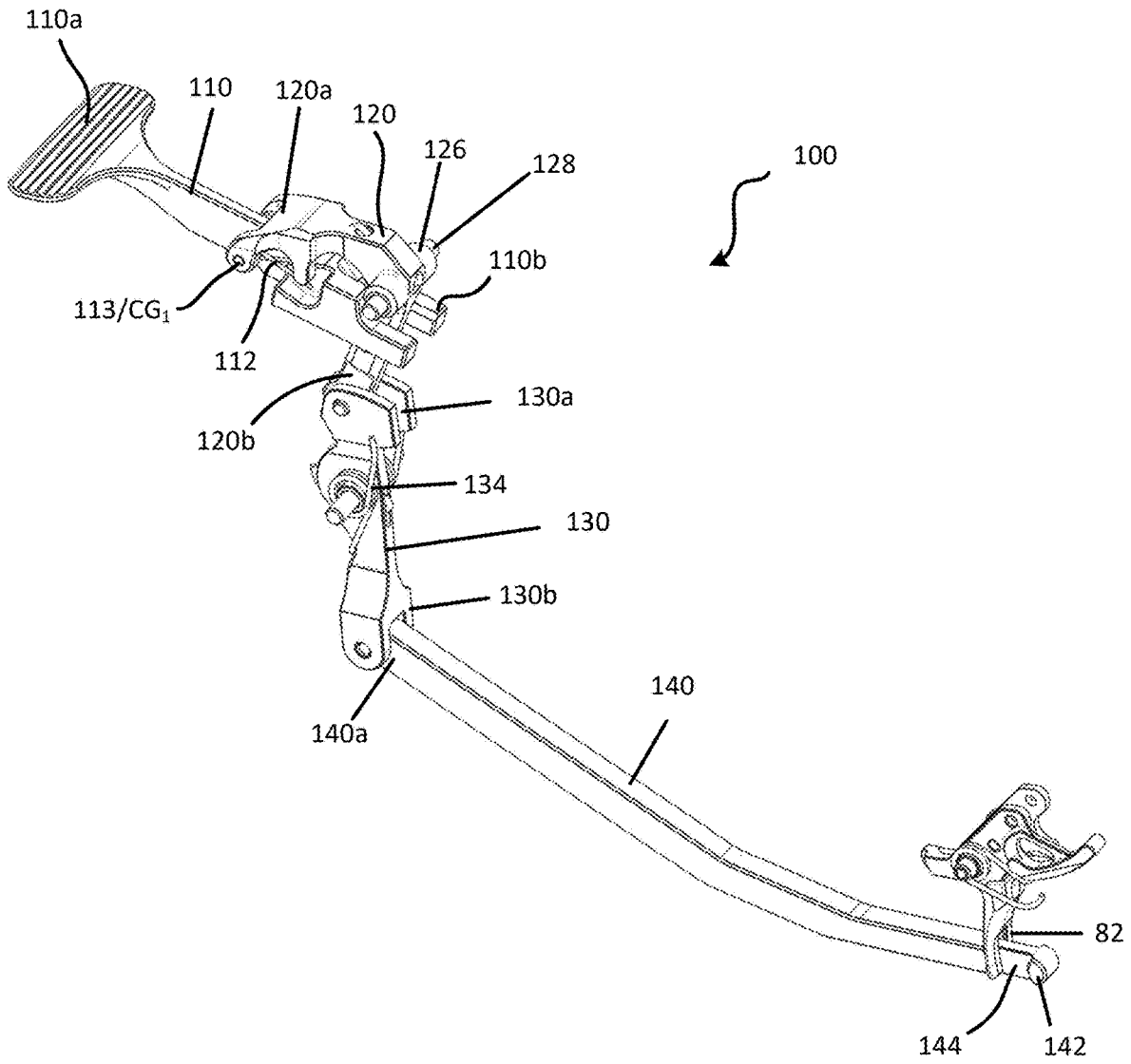
FIG. 3B shows the trigger and components of the trigger lever assembly shown in FIG. 3A.

FIG. 3A illustrates a side view of a housing 80 with a trigger 82 and components of the trigger lever assembly 100, in accordance with an embodiment of the present disclosure. In this example, the housing 80 is illustrated as being transparent to better illustrate components of the trigger lever assembly 100. FIG. 3B shows a front and side perspective view of the trigger 82 together with components of the trigger lever assembly 100 shown in FIG. 3A.

The trigger lever assembly 100 includes trigger lever 110, which extends from a first end 110*a* to a second end 110*b*. The first end 110*a* is configured for manipulation by an operator to fire the gun. The first end 110*a* is illustrated as defining a T-shape, but it is not restricted to this geometry and other configurations can be used. For example, the first end 110*a* can have two paddles arranged in a U-shape for operation by one or both thumbs. The first end 110 can have some other suitable configuration, as will be appreciated. The second end 110*b* is received in the housing 80 and is configured to engage a first link 120 (also referred to as a top link 120).

The trigger lever 110 is pivotably mounted to the first link 120, using a pin, for example, and is biased by a bias spring 112 toward a resting or upward position. Here, the bias spring 112 is a torsion spring and biases the second end 110*b* of the trigger lever 110 downward (i.e., clockwise as shown in FIG. 3A) towards or into contact with a protrusion 124 on the first link 120. Other types of springs could be used, such as a coil spring between the second end 110*b* and the second link 130.

In this example, the trigger lever 110 is configured to rotate about its center of gravity $CG_1$. That is, the center of gravity $CG_1$ is closely adjacent to, coincident with, or forward of the trigger lever's pivot pin 113. In this example, $CG_1$ is vertically below the pivot pin 113. As a result, in the event of an impulse imparting vertical acceleration on the assembly, the trigger lever 110 would not favor rotating in one rotational direction about the pivot pin 113, such as to counter the force of bias spring 112.

In this example, the second end 110*b* is split and receives part of the first link 120. As shown, for example, the second end 110*b* is forked such that part of the first link 120 is movably received between tines of the fork. When the trigger lever 110 is fully pivoted with respect to the first link 120, the second end 110*b* contacts bosses 126 around the pivot pin 128 of the first link 120. From that position, pushing down on the first end 110*a* of the trigger lever 110 causes the first link 120 to rotate about pivot pin 126 in a counterclockwise direction as shown in FIG. 3A.

The first link 120 is pivotably mounted to the housing 80. In this example, the first link 120 generally has an inverted L shape with a first leg 121 extending generally rearward and a second leg 123 extending generally downward. In the resting position in this example, the first leg 121 extends substantially horizontally and the second leg 122 extends downward and rearward at an angle of about 30° with respect to the vertical. The first link 120 can rotate about the pivot pin 128 or equivalent structure. A first end 120*a* of the first link 120 is pivotably connected to the trigger lever 110. A second end 120*b* of the first link 120 is operably coupled to a second link 130, which may also be referred to as a mid-link or middle link 130.

At rest, the second link 130 generally has an upright or vertical position in the housing 80 and can rotate about pin 132. A reset spring 134 biases the second link 130 in a counterclockwise direction as shown in FIG. 3A, where the second end 120*b* of the first link 120 stops on an up stop 84 directly or via the second end 120*b* of the first link 120. The reset spring 134 is configured as a torsion spring in this example. In use, the reset spring 134 returns the components of the trigger lever assembly 100 to the resting position, such as shown in FIG. 3A. A second end 130*b* or lower end 130*b* of the second link 130 is coupled to a first end 140*a* of a third link 140.

The third link 140 extends from the second link 130 in a generally forward direction to a distal end portion 140*b*. In this example, the third link 140 extends downward and forward to the distal end portion 140*b*. The distal end portion 140*b* defines a catch surface 142 configured and positioned to pull the trigger 82 when the operator presses the trigger lever 110 down to the fire position. The catch surface 142 is located distally of a take-up gap 144 or take-up region on the third link 140. In the resting position, the catch surface 142 is spaced from the trigger 82 by a take-up gap 144. As the trigger lever 110 is pressed downward, the catch surface 142 travels rearward into contact with the trigger 82, then continues while pulling the trigger to the fire position.

As can be seen in FIG. 3B, the trigger 82 has a split structure that defines a slot. The take-up gap 144 of the third link 140 is received in the slot between portions of the trigger 82. In other embodiments, the distal end portion 140*b* of the third link 140 can pass around or below the trigger 82, rather than being received in the slot.

Movement of the components of the trigger lever assembly 100 is limited by stops on the housing 80 or on other components. Downward movement of the first end 110*a* of the trigger lever 110 is limited by a down stop 86. The down stop 86 limits rotation of the first link 120 due to its connection to the trigger lever 110. In turn, the down stop 86 limits movement of the trigger lever assembly 100 to the firing position. Upward movement of the first end 110*a* of the trigger lever 110 is limited by an up stop 84, which contacts the second end 120*b* of the first link 120 when the assembly is in the resting position. The up stop 84 also prevents further counterclockwise rotation of the second link 130 (as viewed in FIG. 3A). A pivot stop 88 obstructs rotation of the first link 120 when the trigger lever 110 has not first rotated so that the second end 110*b* of the trigger lever 110 abuts the boss 126. When the trigger lever 110 has not been depressed, either by an operator or by some other force, the second end 110*b* of the trigger lever 110 is aligned to contact the pivot stop 88, thereby preventing the trigger lever assembly 100 from moving to the firing position.

Components of the trigger lever assembly 100 are biased towards a resting position, such as shown in FIG. 3A. The trigger lever 110 is biased by spring 112 in a clockwise direction (as viewed in FIG. 3A) towards the resting position, which is limited by the protrusion 124 on the first link 120. In the resting position, the first end 110*a* of the trigger lever 110 is in an upward or raised position. The second link 130 is biased by the reset spring 134 in a counterclockwise position towards the resting position, which in turn rotates the first link clockwise (as viewed in FIG. 3A) to return the first link 120 and trigger lever 110 to the up or resting position. Moving the second link 130 to the resting position shifts the third link 140 to a forward position where the catch surface 142 disengages from the trigger 82.

Figure 3C:
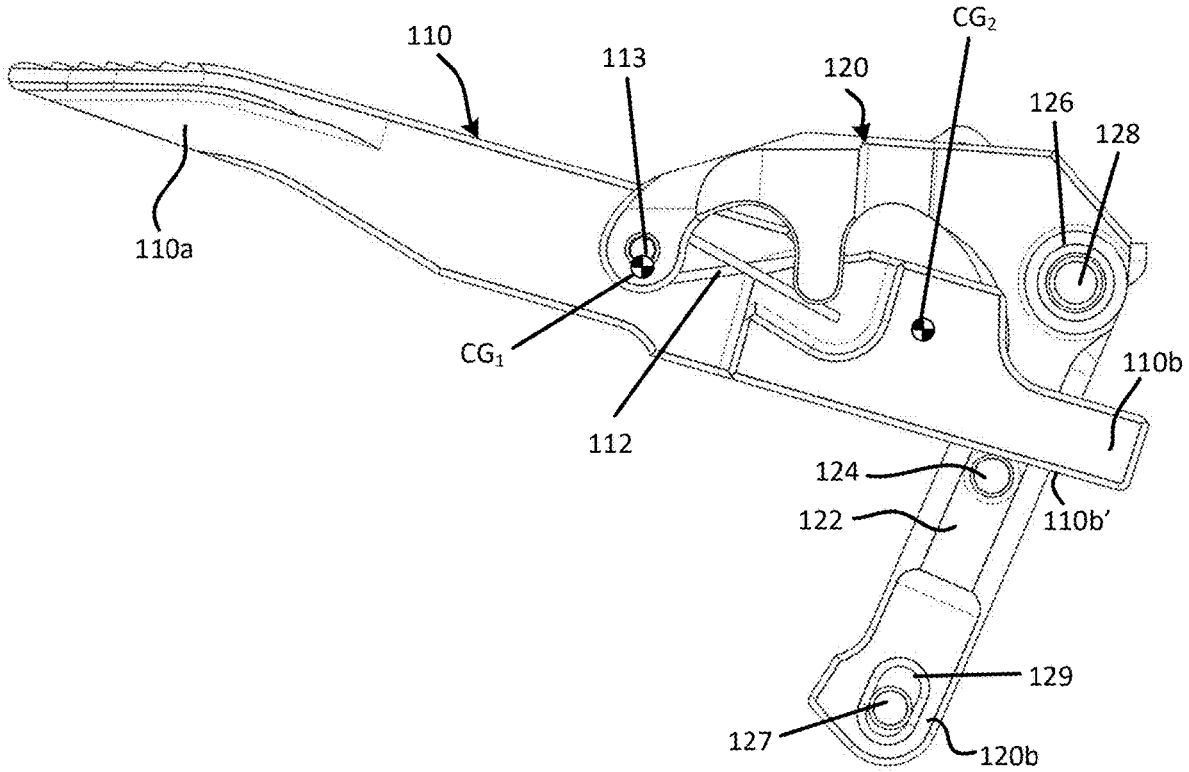
FIG. 3C illustrates a side view of an assembly that includes a trigger lever and first link, in accordance with an embodiment of the present disclosure.

FIG. 3C illustrates a side view of a trigger lever 110 and first link 120 in an assembled form, in accordance with an embodiment of the present disclosure. In this example, the trigger lever 110 is in a resting position with the bottom surface 110*b*' along the second end 110*b* abutting the protrusion 124 on the second leg 122 of the first link 120. Spring 112 biases the trigger lever 110 towards the resting position. The trigger lever 110 can rotate about the pivot pin 113 between the resting position (abutting protrusion 124) and a firing position in which the second end 110*b* abuts the boss 126 around the pivot pin 128.

The trigger lever 110 has a center of gravity $CG_1$ vertically below the pivot pin 113 or forward of the pivot pin 113. In some embodiments the center of gravity $CG_1$ is within the diameter of the pivot pin 113, within two radii of the center of the pivot pin 113, or within three radii of the center of the pivot pin 113, for example. The assembly of the trigger lever 110, first link 120, pivot pin 113, pivot pin 128, pin 127, and spring 112 has a center of gravity $CG_2$ that is roughly halfway between the pivot pin 113 of the trigger lever 110 and the pivot pin 128 of the first link 120. The second end 120*b* of the first link 120, which is at the end of the second leg 122, defines a slot 129 with a pin 127 that connects the first link 120 to the second link 130 (shown in FIG. 3A).

Figure 4A:
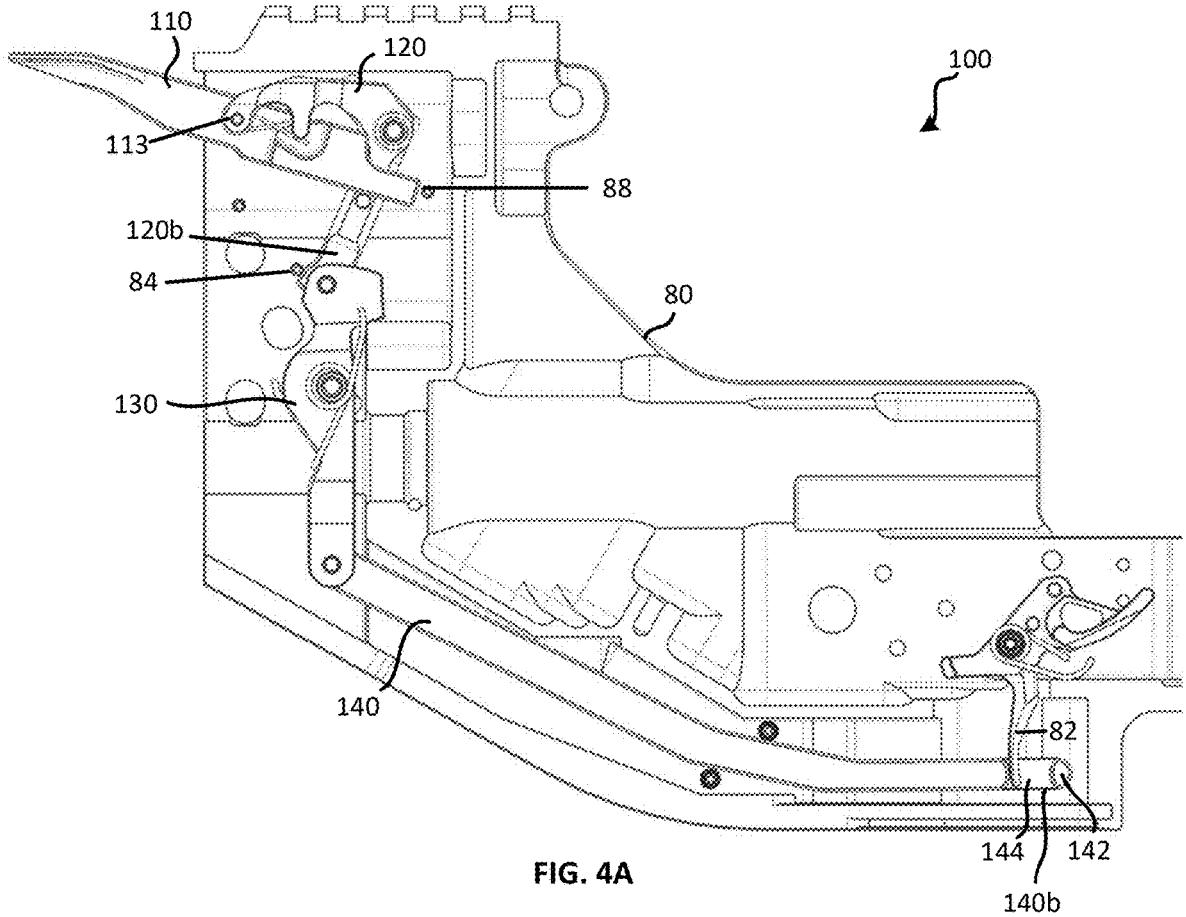
FIG. 4A is a side view of the trigger lever assembly and housing of FIG. 1 and shows the trigger lever at rest, in accordance with an embodiment of the present disclosure.
Figure 4B:
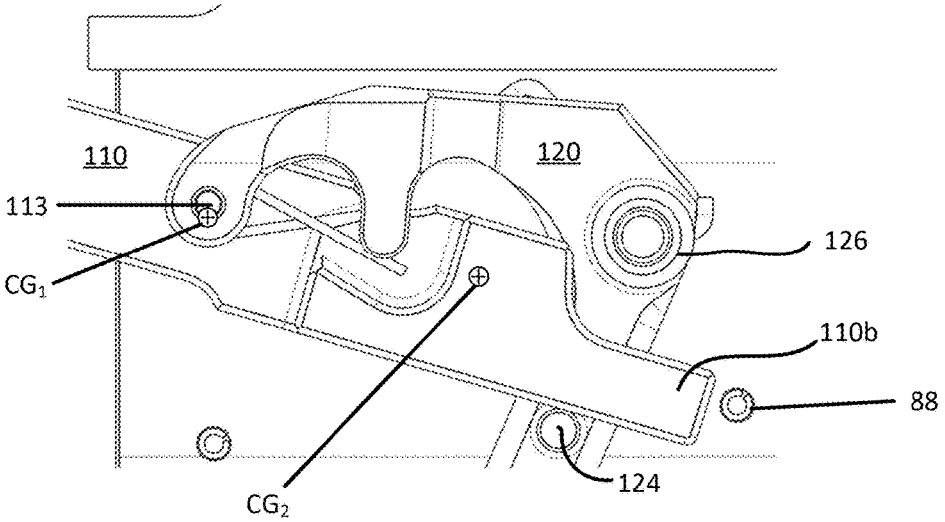
FIG. 4B is a close-up view showing part of the trigger lever and a first link of FIG. 4A.

FIG. 4A is a side view of the assembly of FIG. 1 and shows the trigger lever 110 at rest, in accordance with an embodiment of the present disclosure. FIG. 4B is a close-up view showing part of the trigger lever 110 and first link 120 of FIG. 4A. In the resting position, the trigger lever 110 occupies an upward or raised position, which is limited by the up-stop 84 contacting the second end 120*b* of the first link 120. Note that the trigger 82 is received in the take-up gap 144 at the distal end 140*b* of the third link 140 so that the catch surface 142 is spaced from the front of the trigger 82. In the resting position of FIG. 3A, note also that the rear surface of the trigger 82 abuts or is closely adjacent the third link 140 at the rear of the take-up gap 144. In this way, the third link 140 acts to prevent an inadvertent trigger pull by some other means, such as a rearward-acting impulse. In the resting position, the up-stop 84 and pivot stop 88 also function to stabilize the forward position of the third link 140 and prevent directly pulling the trigger 82.

As shown in FIG. 4B, the center of gravity $CG_1$ of the trigger lever 110 is closely adjacent to its axis of rotation at pin 113. Here, $CG_1$ is vertically below the pin 113. The center of gravity $CG_2$ of the combination of the trigger lever 110 and first link 120 is about halfway between the pivot stop 88 and $CG_1$. Thus, in response to a downward acting force, the trigger lever 110 will tend to maintain its resting position with respect to the first link 120 and the first link 120 will tend to rotate counterclockwise (as shown in FIG. 4B). However, due to pivot stop 88 making contact with the second end 110*b* of the trigger lever 110, the first link 120 is blocked from rotating in a counterclockwise direction. The protrusion 124 and boss 126 on the first link 120 are also shown.

Figure 5A:
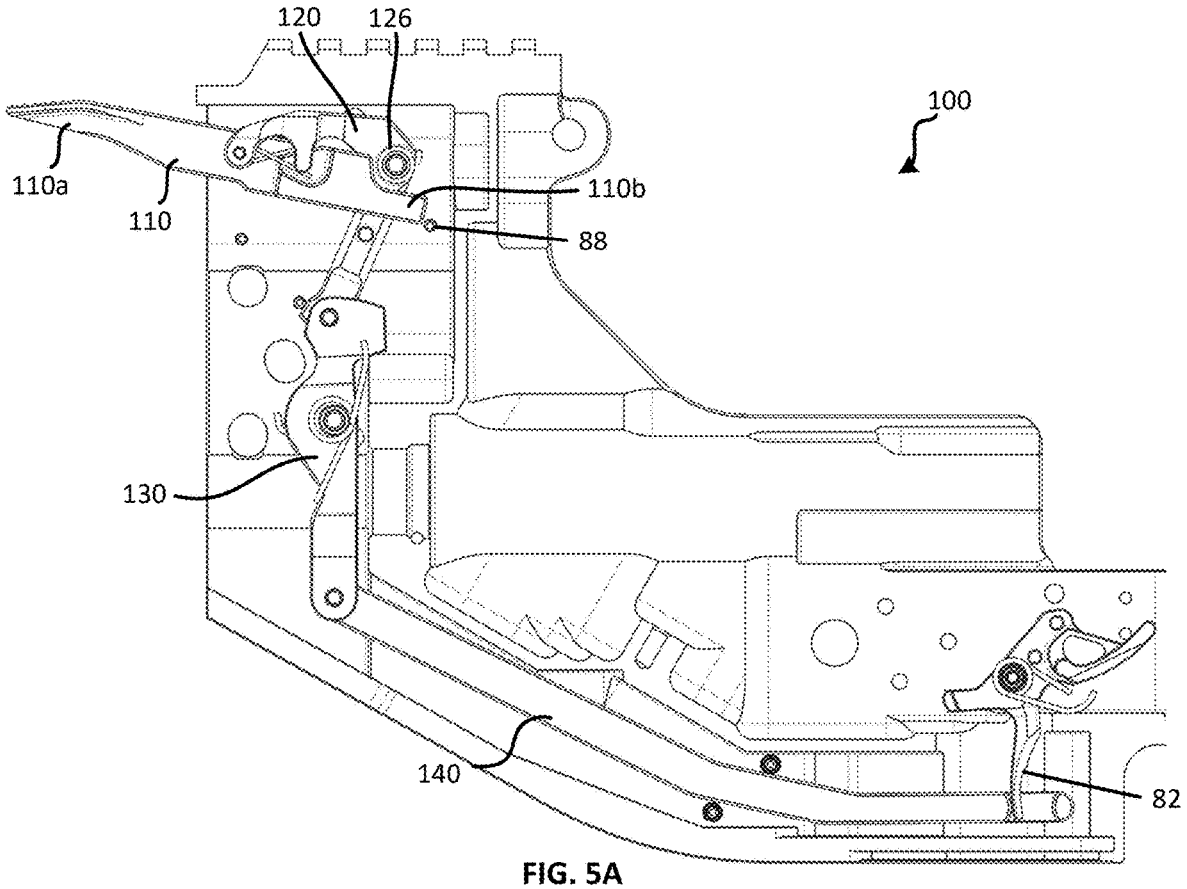
FIG. 5A is a side view of the assembly of FIG. 1 and shows the trigger lever during early stages of being pressed down, in accordance with an embodiment of the present disclosure.
Figure 5B:
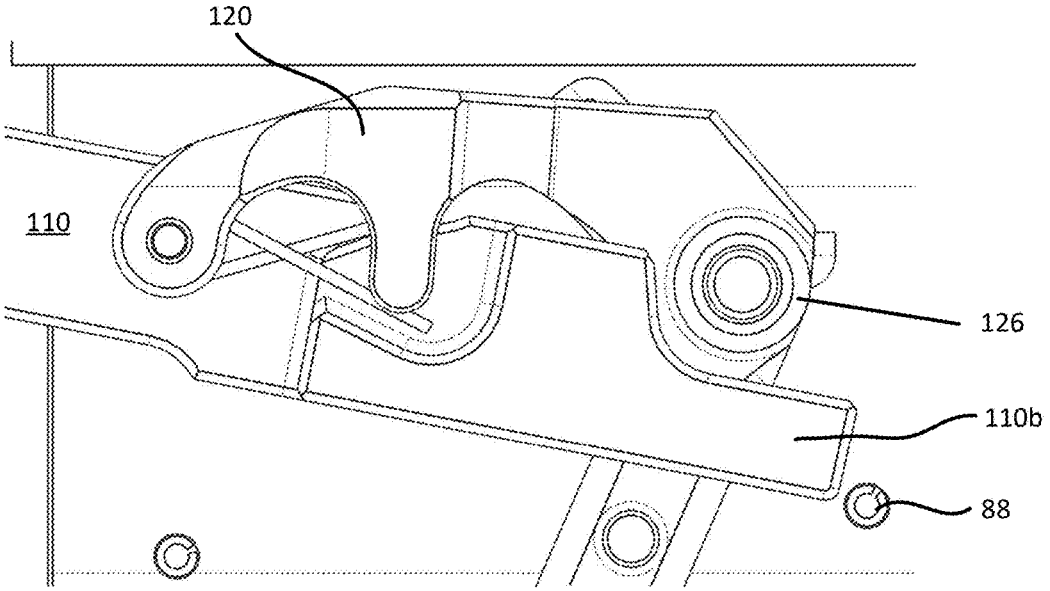
FIG. 5B is a close-up view showing part of the trigger lever and first link of FIG. 5A.

FIG. 5A is a side view of the assembly of FIG. 1 and shows initial downward movement of the first end 110*a* of the trigger lever 110 toward the firing position, in accordance with an embodiment of the present disclosure. FIG. 5B is a close-up view showing part of the trigger lever 110 and first link 120 shown in FIG. 5A. Compared to the resting position shown in FIG. 4A, the trigger lever 110 has rotated partially towards the firing position. Note that the second end 110*b* of the trigger lever is close to making contact with the boss 126 on the first link 120. In this position, the second end 110*b* of the trigger lever 110 is close to occupying a clearance position with respect to the pivot stop 88. Further pressing down on the trigger lever 110 will cause the trigger lever 110 to clear the pivot stop 88, followed by contacting the boss 126 and rotating the first link 120. The positions of the first link 120, second link 130, and third link 140 remain unchanged compared to the resting position shown in FIG. 4A.

Figure 6A:
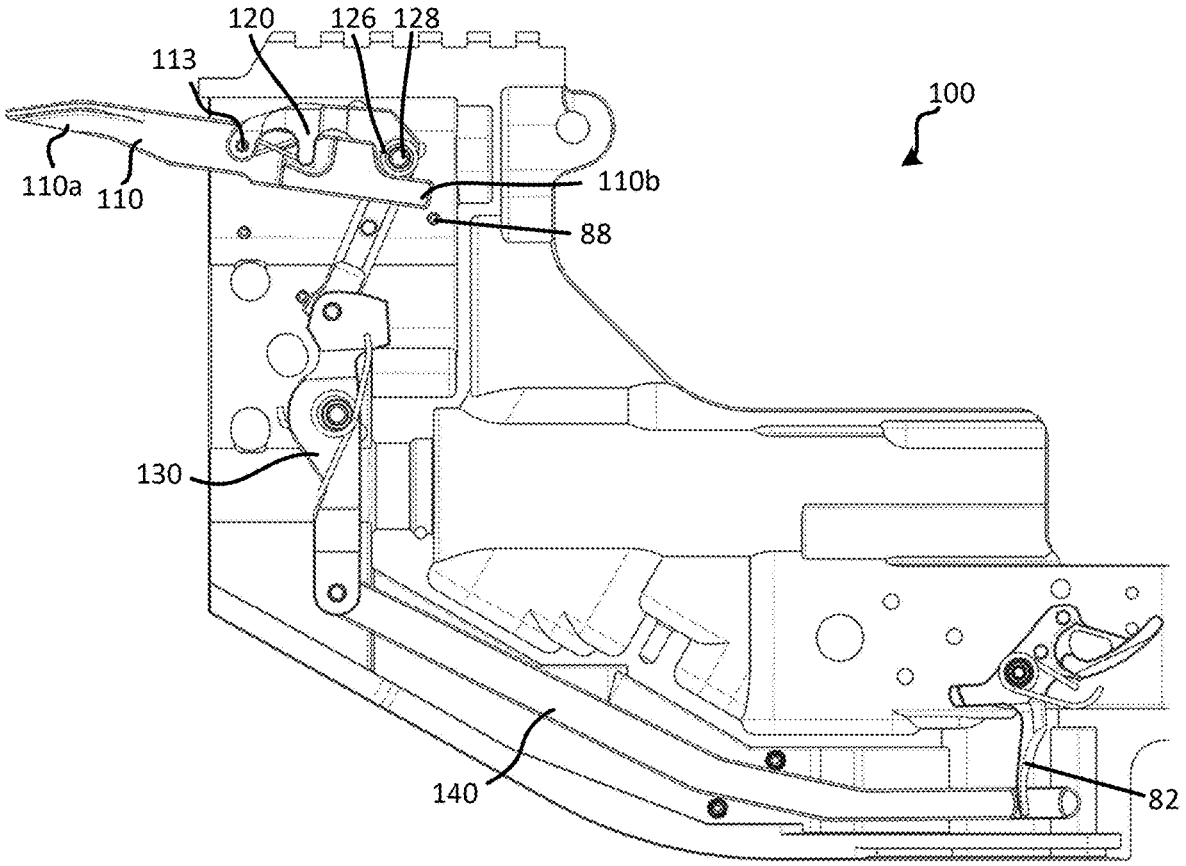
FIG. 6A is a side view of the assembly of FIG. 1 and shows the trigger lever disengaged from the stop pin and abutting the first link at a boss around its pivot point, in accordance with an embodiment of the present disclosure.
Figure 6B:
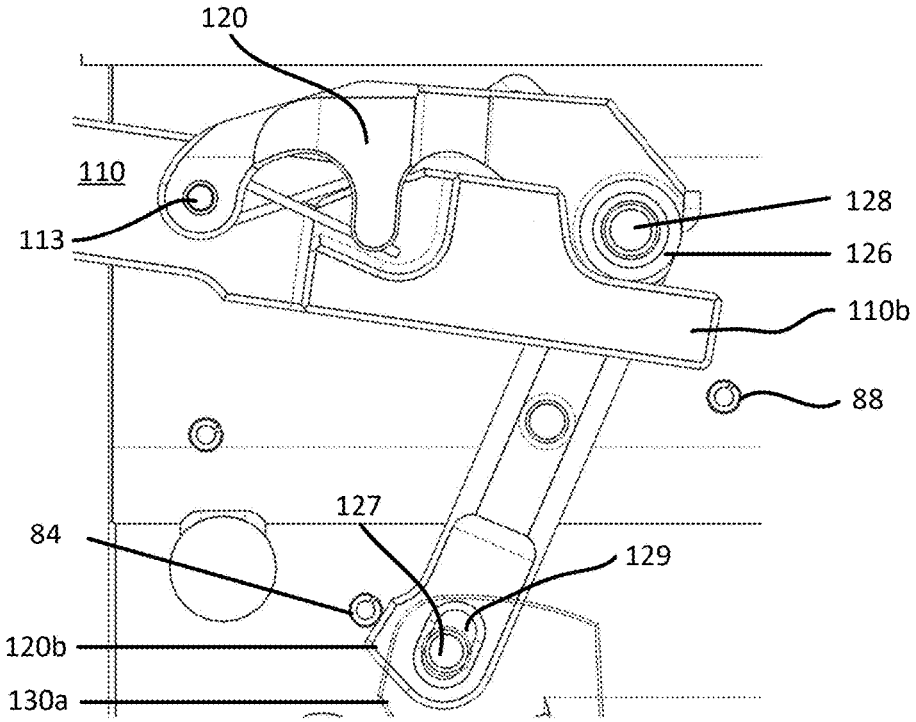
FIG. 6B is a close-up view showing part of the trigger lever and first link of FIG. 6A.

FIG. 6A is a side view of the assembly of FIG. 5A where the first end 110*a* of the trigger lever 110 has pivoted further downward compared to the position shown in FIG. 5A. FIG. 6B is a close-up view showing part of the trigger lever 110 and first link 120 shown in FIG. 6A. In this position, the trigger lever 110 has rotated about the pivot pin 113 so that the second end 110*b* of the trigger lever 110 abuts the boss 126 on the first link 120. As a result, the second end 110*b* of the trigger lever is clear of the pivot stop 88 and the first link 120 can rotate about pivot pin 128. The positions of the first link 120, second link 130, and third link 140 remain unchanged compared to the resting position shown in FIG. 4A. From the position shown in FIG. 6A, pressing further down on the first end 110*a* of the trigger lever 110 will start to pivot the first link 120 counterclockwise, which in turn will rotate the second link 130 clockwise and move the third link 140 rearward. As best seen in FIG. 6B, note that the second end 120*b* of the first link 120 is connected to the first end 130*a* of the second link 130 via a slotted interface. For example, a pin 127 connecting the first link 120 to the second link 130 is received in a slot 129 in one of these components. In this example, the slot 129 is defined in the second end 120*b* of the first link 120. This slotted interface is provided to enable rotation of the first link 120 and second link 130 throughout the range of operation of the trigger lever 110.

Figure 7A:
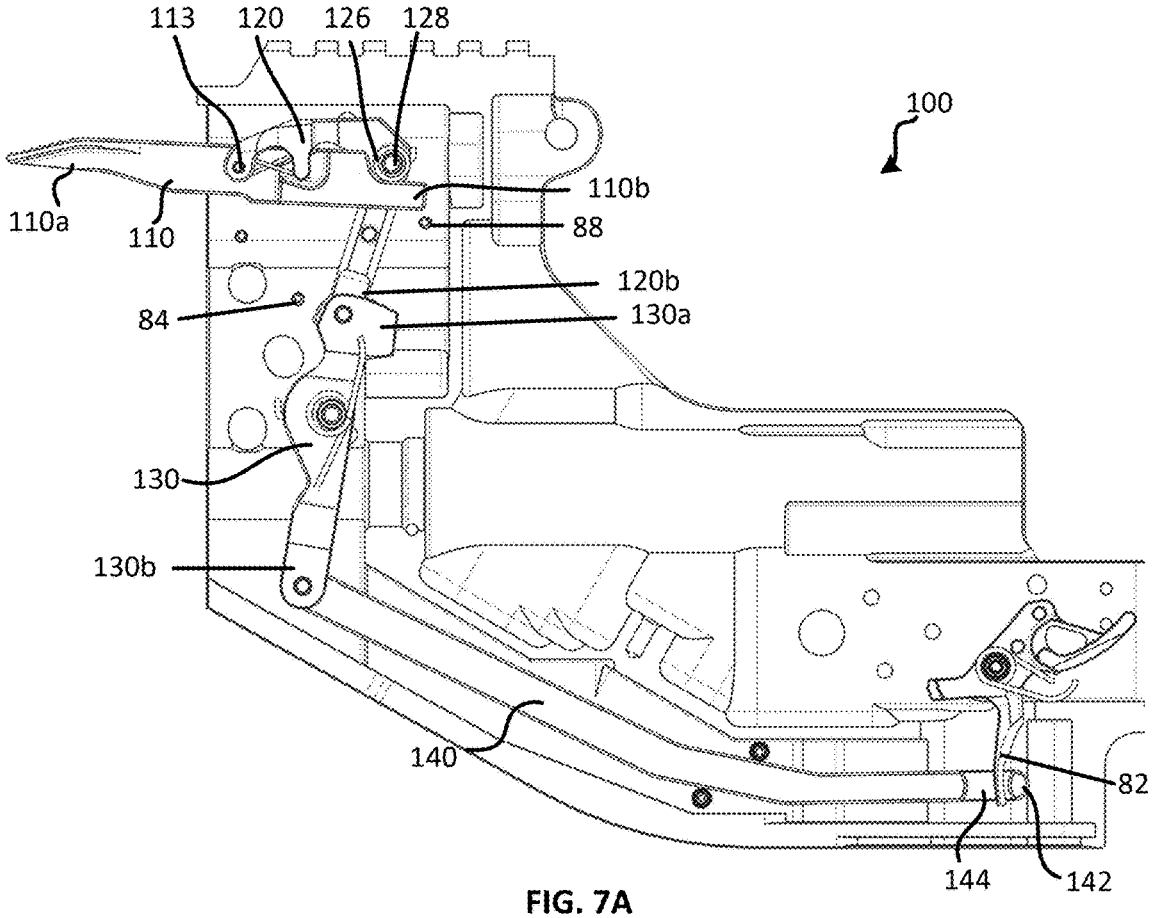
FIG. 7A is a side view of the assembly of FIG. 1 and shows the trigger lever pressed further toward a firing condition, in accordance with an embodiment of the present disclosure.
Figure 7B:
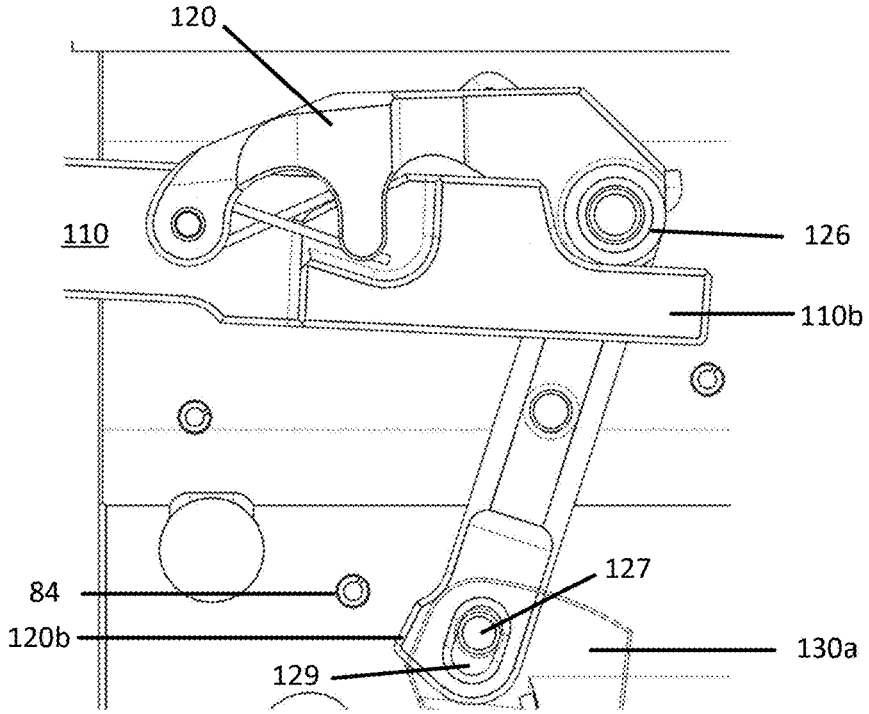
FIG. 7B is a close-up view showing part of the trigger lever and first link of FIG. 7A.

FIG. 7A is a side view of the assembly of FIG. 6A and shows the first end 110*a* of the trigger lever 110 after being pressed further downward toward a firing condition, in accordance with an embodiment of the present disclosure. FIG. 7B is a close-up view showing part of the trigger lever 110 and first link 120 of FIG. 7A. In this position, which may be described as part of a take-up phase of the trigger lever 110 movement, the second end 110*b* of the trigger lever 110 remains in contact with the boss 126 on the first link 120 and the second end 120*b* of the first link 120 has pivoted away from the up-stop 84. In doing so, the second link 130 has started to rotate clockwise as illustrated in FIG. 7A. That is, the first end 130*a* has pivoted forward and the second 130*b* has pivoted rearward. The rotation of the second link 130 has drawn the third link 140 rearward. Note that the trigger 82 remains in the take-up gap 144; however, the catch surface 142 is close to making contact with the trigger 82. As best seen in FIG. 7B, note that the pin 127 connecting the first link 120 to the second link 130 has shifted towards an upper end of the slot 129.

Figure 8A:
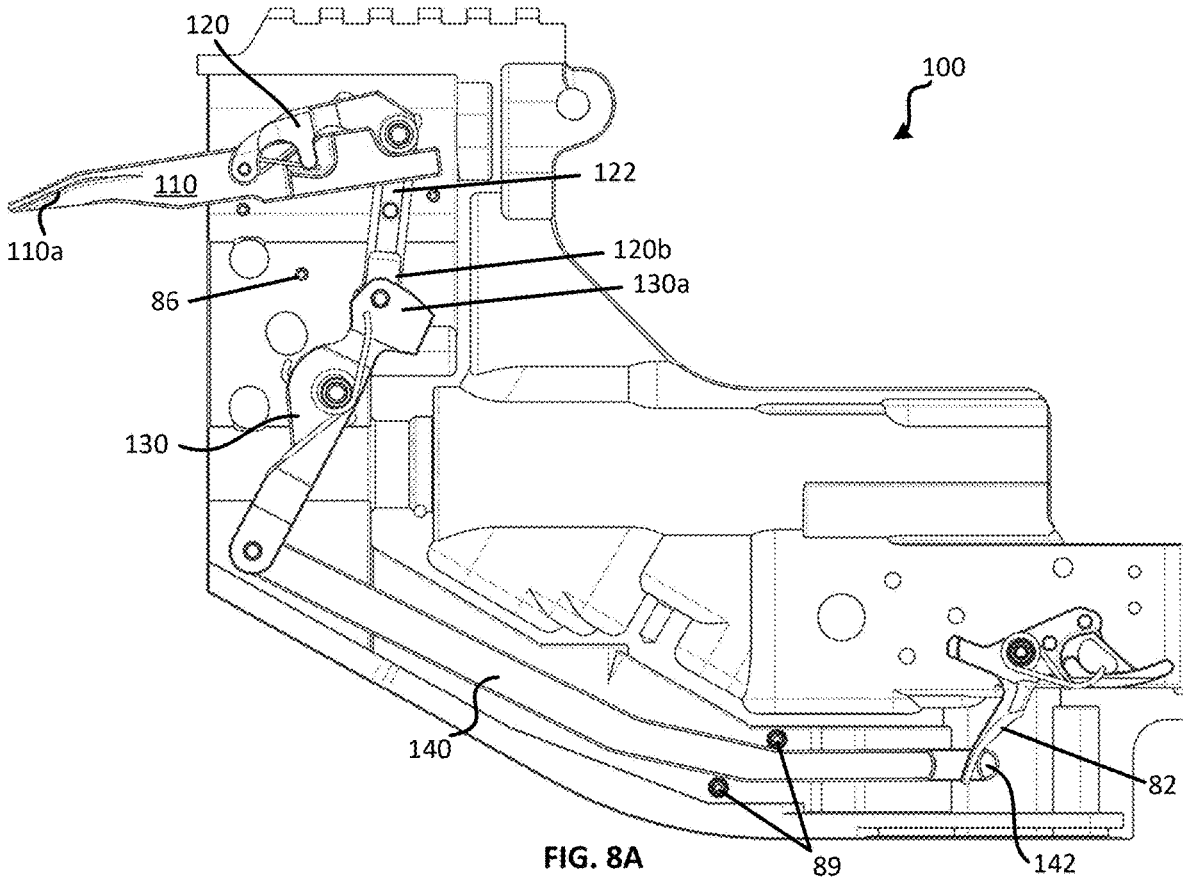
FIG. 8A is a side view of the assembly of FIG. 1 and shows the first end of the trigger lever pivoted down to a firing position, in accordance with an embodiment of the present disclosure.
Figure 8B:
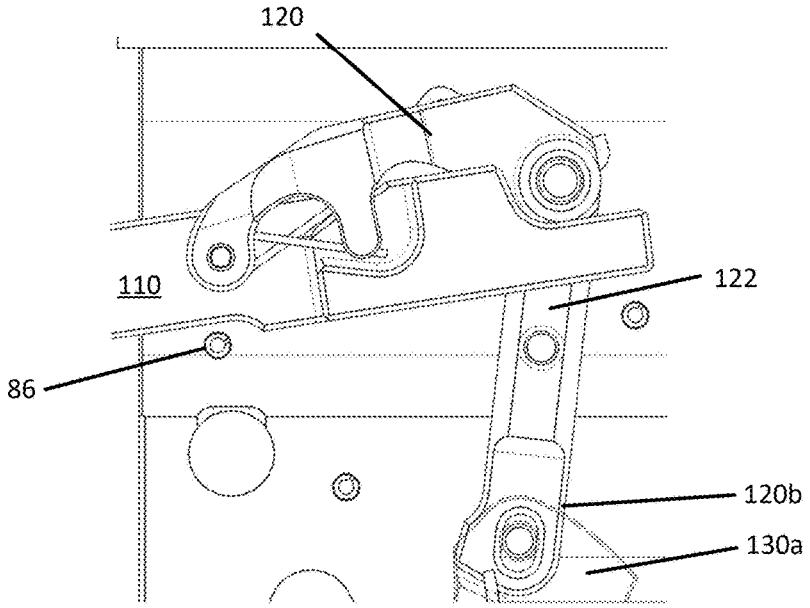
FIG. 8B is a close-up view showing part of the trigger lever and first link of FIG. 8A.

FIG. 8A is a side view of the assembly of FIG. 7A and shows the first end 110*a* of the trigger lever 110 pivoted down to a firing position, in accordance with an embodiment of the present disclosure. FIG. 8B is a close-up view showing part of the trigger lever 110 and first link 120 of FIG. 8A. In this example, the trigger lever 110 has achieved nearly full rotation to where it makes contact with the down stop 86. The second leg 122 of the first link 120 is substantially vertical (e.g., ±10°). The second link 130 has rotated clockwise (as viewed in FIG. 8A) by about 30°, which has drawn the third link 140 rearward an amount sufficient to pull the trigger 82 rearward to the fire position due to engagement with the catch surface 142. Guide pins 89 above and below the third link 140 can be included to guide the distal end portion 140*b* of the third link 140 to move substantially in a longitudinal direction.

Figure 9A:
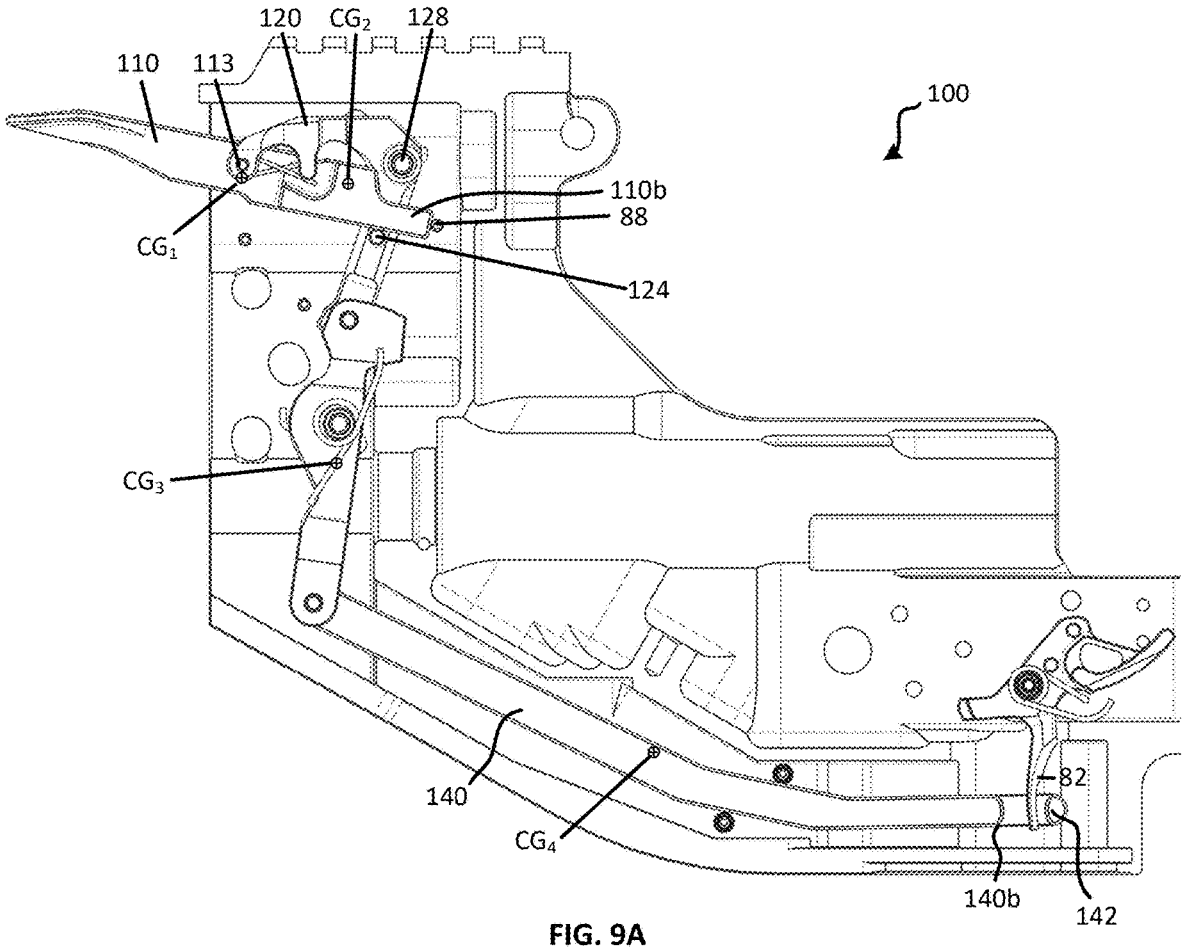
FIG. 9A is a side view of the assembly of FIG. 1 during an impulse where the stop pin prevents the trigger lever and the first link from pivoting to a firing condition, in accordance with an embodiment of the present disclosure.
Figure 9B:
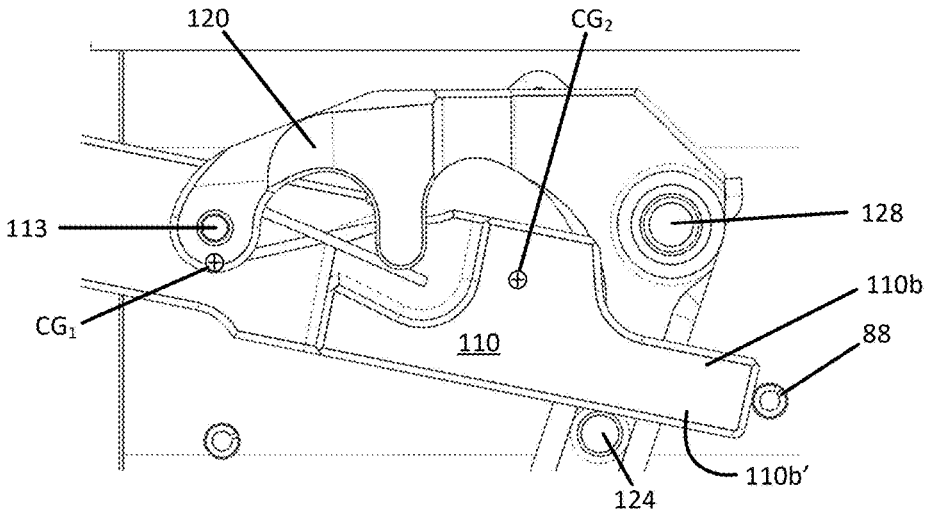
FIG. 9B is a close-up view showing part of the trigger lever and first link of FIG. 9A.

FIG. 9A is a side view of the assembly 100 of FIG. 3A during an impulse, in accordance with an embodiment of the present disclosure. FIG. 9B is a close-up view showing part of the trigger lever 110 and first link 120 of FIG. 9A. One such impulse is a vertical drop or other event that imparts linear or rotational acceleration to the assembly 100. For example, dropping the firearm, vehicle jostling, or similar impulse can impart acceleration on components of the trigger lever assembly 100 in a direction that is vertical or within a range of directions from downward and forward to downward and rearward. For example, the range spans about 90°, such as ±45° from vertical.

Note that the position of the trigger lever 110 remains unchanged with respect to the first link 120 compared to the resting position shown in FIG. 4A, as indicated by the lower surface 110*b*' of the second end 110*b* abutting the protrusion 124 on the first link 120. The trigger lever 110 does not rotate due to the center of gravity $CG_1$ being coaxial with or closely adjacent to the pivot pin 113 and due to spring 112 biasing the trigger lever 110 towards the resting position.

However, due to the trigger lever 110 and first link 120 having a combined center of gravity $CG_2$ that is rearward of the pivot pin 128, the first link 120 has rotated counterclockwise until the second end 110*b* of the trigger lever 110 abuts the stop pin 88, which applies a load opposing the rotation of the first link 120 and preventing the first link 120 from further rotating to a firing condition. In some embodiments, this rotation is not more than 10°, including not more than 7°, and not more than 5°. In this particular example, the rotation is about 6°. Due to contact with the stop pin 88 and mechanical link between the first, second, and third links 120, 130, 140, the movement of the second link 130 and third link 140 is also limited. Accordingly, the catch surface 142 at the distal end portion of the third link 140 moves rearward, but by an amount that is insufficient to contact the trigger 82. In the example shown, the catch surface 142 moves rearward, but it does not contact the trigger 82. In some embodiments, a gap between the catch surface 142 and the trigger 82 when the trigger lever 110 abuts the stop pin 88 is at least 1 mm. A gap of smaller or greater size can be used as deemed appropriate for a particular firearm and the associated tolerances, for example.

Further Example Embodiments

The following examples pertain to further embodiments, from which numerous permutations and configurations will be apparent.

Example 1 is a trigger lever assembly that includes a link rotatable about an axis of rotation between a first position and a second position. The link has a first leg extending from the axis of rotation to a first end portion and a second leg extending from the axis of rotation to a second end portion. A trigger lever is mounted to the first end portion of the link and is rotatable between a blocked position and an unblocked position. The trigger lever has a first end portion and a second end portion. A spring biases the trigger lever to the blocked position. When the trigger lever is in the blocked position, the second end portion of the trigger lever contacts a first protrusion on the link. When the trigger lever is in the unblocked position, the second end portion of the trigger lever abuts a second protrusion on the link.

Example 2 includes the trigger lever assembly of Example 1 and further includes a housing, where the link is rotatably mounted to the housing. A stop surface on the housing is positioned to contact the distal end portion of the trigger lever to prevent rotation of the link out of the first position when the trigger lever is in the blocked position.

Example 3 includes the trigger lever assembly of Example 2, where the link is a first link and the assembly further comprises a second link rotatably mounted to the housing and having a first end coupled to the second end of the first link, the second link rotatable between a resting position and a fire position. A reset spring biases the second link toward the resting position, thereby biasing the first link to the first position. A third link is movably retained in the housing. The third link has a first end coupled to the second end of the second link and has a distal end portion extending longitudinally, the distal end portion having a catch surface configured to engage a trigger. After moving the trigger lever to the unblocked position, pressing further down on the first end portion of the trigger rotates the first link and causes the distal end portion of the third link to move rearward.

Example 4 includes the trigger lever assembly of Example 3, where the distal end portion of the third link defines a take-up portion between the catch surface and a body of the third link, the take-up portion having a reduced lateral thickness compared to the body.

Example 5 includes the trigger lever assembly of Example 4, where the take-up portion comprises a recess in a first lateral side of the third link.

Example 6 includes the trigger lever assembly of Example 5, where the recess is a first recess and the take-up portion defines a second recess in an opposite second lateral side of the third link.

Example 7 includes the trigger lever assembly of any one of Examples 3-6 and further comprises a trigger mounted to the housing and pivotable between a trigger resting position and a trigger fire position. When the trigger is in the trigger resting position, the trigger occupies the take-up portion of the third link. Pushing down the trigger lever beyond the unblocked position causes the catch surface to move rearward and pull the trigger toward the fire position.

Example 8 includes the trigger lever assembly of Example 7, where the trigger is configured as a split trigger that defines a gap, and where the take-up portion of the third link is movably received in the gap.

Example 9 includes the trigger lever assembly of Example 7, where the trigger is received in the take-up portion of the third link when the trigger is in the trigger resting position.

Example 10 includes the trigger lever assembly of Example 9, where the trigger abuts the body of the third link when the trigger is in the trigger resting position.

Example 11 includes the trigger lever assembly of any one of Examples 4-10, where the take-up portion is configured to move longitudinally along the trigger during a take-up phase of the trigger lever assembly.

Example 12 includes the trigger lever assembly of any one of Examples 1-11, where the stop surface is a pin installed in the housing.

Example 13 includes the trigger lever assembly of any one of Examples 1-11, where the stop surface is a protrusion on the housing.

Example 14 includes the trigger lever assembly of any one of Examples 1-13, where the second protrusion is a boss around the axis of rotation of the first link.

Example 15 includes the trigger lever assembly of any one of Examples 1-14, where the link generally defines an inverted L-shape.

Example 16 includes the trigger lever assembly of any one of Examples 1-15, where the trigger lever has a center of gravity that is coincident with, vertically below, or forward of an axis of rotation of the trigger lever.

Example 17 is a spade grip assembly comprising the trigger lever assembly of any one of Examples 2-16 and includes grips mounted to opposite sides of the housing.

Example 18 is a machine gun comprising the trigger lever assembly of any one of Examples 1-16.

Example 19 includes the machine gun of Example 17 and further comprises grips mounted to opposite lateral sides of the housing.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A trigger lever assembly comprising:

a link rotatable about an axis of rotation between a first position and a second position, the link having a first leg extending from the axis of rotation to a first end portion and a second leg extending from the axis of rotation to a second end portion; and a trigger lever mounted to the first end portion of the link and rotatable between a blocked position and an unblocked position, the trigger lever having a first end portion and a second end portion;

wherein the trigger lever is biased toward the blocked position and in the blocked position, the second end portion of the trigger lever contacts a first protrusion on the link and wherein in the unblocked position, the second end portion of the trigger lever abuts a second protrusion on the link.

2. The trigger lever assembly of claim 1, further comprising:

a housing, wherein the link is rotatably mounted to the housing; and a stop surface on the housing, wherein the stop surface is positioned to contact the distal end portion of the trigger lever to prevent rotation of the link out of the first position when the trigger lever is in the blocked position.

3. The trigger lever assembly of claim 2, wherein the link is a first link and the assembly further comprises:

a second link rotatably mounted to the housing and having a first end coupled to the second end of the first link, the second link rotatable between a resting position and a fire position;

a reset spring biasing the second link toward the resting position, thereby biasing the first link to the first position; and a third link movably retained in the housing, the third link having a first end coupled to the second end of the second link and having a distal end portion extending longitudinally, the distal end portion having a catch surface configured to engage a trigger;

wherein, after moving the trigger lever to the unblocked position, pressing further down on the first end portion of the trigger rotates the first link and causes the distal end portion of the third link to move rearward.

4. The trigger lever assembly of claim 3, further comprising:

a trigger mounted to the housing and pivotable between a trigger resting position and a trigger fire position;

wherein in the trigger resting position the trigger occupies the take-up portion of the third link; and wherein pushing down the trigger lever beyond the unblocked position causes the catch surface to move rearward and pull the trigger toward the fire position.

5. The trigger lever assembly of claim 3, wherein the distal end portion of the third link defines a take-up portion between the catch surface and a body of the third link, the take-up portion having a reduced lateral thickness compared to the body.

6. The trigger lever assembly of claim 5, wherein the take-up portion comprises a recess in a first lateral side of the third link.

7. The trigger lever assembly of claim 6, wherein the recess is a first recess and the take-up portion defines a second recess in an opposite second lateral side of the third link.

8. The trigger lever assembly of claim 7, further comprising:

a trigger mounted to the housing and pivotable between a trigger resting position and a trigger fire position;

wherein in the trigger resting position the trigger occupies the take-up portion of the third link; and wherein pushing down the trigger lever beyond the unblocked position causes the catch surface to move rearward and pull the trigger toward the fire position.

9. The trigger lever assembly of claim 8, wherein the trigger is configured as a split trigger that defines a gap and the take-up portion of the third link is movably received in the gap.

10. The trigger lever assembly of claim 8, wherein the trigger is received in the take-up portion of the third link when the trigger is in the trigger resting position.

11. The trigger lever assembly of claim 10, wherein the trigger abuts the body of the third link when the trigger is in the trigger resting position.

12. The trigger lever assembly of claim 11, wherein the take-up portion is configured to move longitudinally along the trigger during a take-up phase of the trigger lever assembly.

13. The trigger lever assembly of claim 1, wherein the stop surface is a pin installed in the housing.

14. The trigger lever assembly of claim 1, wherein the stop surface is a protrusion on the housing.

15. The trigger lever assembly of claim 1, wherein the second protrusion is a boss around the axis of rotation of the first link.

16. The trigger lever assembly of claim 1, wherein the link generally defines an inverted L-shape.

17. The trigger lever assembly of claim 1, wherein the trigger lever has a center of gravity that is coincident with, vertically below, or forward of an axis of rotation of the trigger lever.

18. A spade grip assembly for a machine gun, the assembly comprising:

a housing;

a first link mounted to the housing and rotatable about an axis of rotation between a first position and a second position, the first link having a first leg extending from the axis of rotation to a first end portion and a second leg extending from the axis of rotation to a second end portion;

a trigger lever mounted to the first end portion of the first link and rotatable between a blocked position and an unblocked position, the trigger lever having a first end portion and a second end portion, wherein the trigger lever is biased toward the blocked position;

a second link rotatably mounted to the housing and having a first end coupled to the second end of the first link, the second link rotatable between a resting position and a fire position, wherein the second link is biased toward the resting position;

a third link movably retained in the housing, the third link having a first end coupled to the second end of the second link and having a distal end portion extending longitudinally, the distal end portion having a catch surface configured to engage a trigger; and a stop surface on the housing, the stop surface positioned to contact the distal end portion of the trigger lever to prevent rotation of the link out of the first position when the trigger lever is in the blocked position;

wherein in the blocked position, the second end portion of the trigger lever contacts a first protrusion on the link and wherein in the unblocked position, the second end portion of the trigger lever abuts a second protrusion on the link.

19. The spade grip assembly of claim 18, further comprising grips mounted to opposite lateral sides of the housing.

20. A machine gun comprising the trigger lever assembly of claim 1.

* * * * *